US010601103B2

(12) United States Patent
Hataya et al.

(10) Patent No.: US 10,601,103 B2
(45) Date of Patent: Mar. 24, 2020

(54) ANTENNA

(71) Applicant: FURUNO ELECTRIC CO., LTD., Hyogo (JP)

(72) Inventors: Mitsuhiko Hataya, Takarazuka (JP); Koji Yano, Itami (JP); Toshifumi Sakai, Amagasaki (JP)

(73) Assignee: FURUNO ELECTRIC CO., LTD., Hyogo (JP)

( * ) Notice: Subject to any disclaimer, the term of this patent is extended or adjusted under 35 U.S.C. 154(b) by 145 days.

(21) Appl. No.: 15/861,483

(22) Filed: Jan. 3, 2018

(65) Prior Publication Data

US 2018/0131072 A1 May 10, 2018

Related U.S. Application Data

(63) Continuation of application No. PCT/JP2016/066818, filed on Jun. 7, 2016.

(30) Foreign Application Priority Data

Jul. 7, 2015 (JP) ..... 2015-135976

(51) Int. Cl.
*H01Q 1/12* (2006.01)
*H01Q 3/08* (2006.01)
(Continued)

(52) U.S. Cl.
CPC ..... *H01Q 1/1264* (2013.01); *H01Q 1/125* (2013.01); *H01Q 1/18* (2013.01); *H01Q 1/34* (2013.01);
(Continued)

(58) Field of Classification Search
CPC ..... H01Q 19/10; H01Q 1/12; H01Q 1/125; H01Q 1/1264; H01Q 1/18; H01Q 1/34;
(Continued)

(56) References Cited

U.S. PATENT DOCUMENTS 2,604,698 A * 7/1952 Ewing ..... H01Q 1/18 342/422
2,740,962 A * 4/1956 Hammond, Jr. ..... G01S 13/422 342/75
(Continued)

FOREIGN PATENT DOCUMENTS

JP 60-30613 U 3/1985
JP 3-270404 A 12/1991
(Continued)

OTHER PUBLICATIONS

International Search Report dated Aug. 9, 2016 in PCT/JP2016/066818.
(Continued)

*Primary Examiner* — Tho G Phan
(74) *Attorney, Agent, or Firm* — Xsensus LLP

(57) ABSTRACT

Provided is a detailed configuration regarding a method of transmitting a driving force etc., of an antenna adjustable of an elevation-depression angle and an antenna circumferential angle. A weather radar antenna may include an antenna unit, a column, an elevation-depression-direction drive transmission shaft, and a circumferential-direction drive transmission shaft. The antenna unit may receive at least an electromagnetic wave. The column may support the antenna unit. The elevation-depression-direction drive transmission shaft may transmit a driving force of an elevation-depression-direction drive motor to the antenna. The circumferential-direction drive transmission shaft may transmit a driving force of a circumferential-direction drive motor to the antenna unit.

20 Claims, 8 Drawing Sheets

(51) Int. Cl.

| | |
|---|---|
| ***H01Q 19/10*** | (2006.01) |
| ***H01Q 1/18*** | (2006.01) |
| ***H01Q 1/34*** | (2006.01) |
| ***H01Q 1/36*** | (2006.01) |
| ***H01Q 1/48*** | (2006.01) |
| *H01Q 1/40* | (2006.01) |

(52) U.S. Cl.
CPC ..... *H01Q 1/362* (2013.01); *H01Q 1/48* (2013.01); *H01Q 3/08* (2013.01); *H01Q 19/10* (2013.01); *H01Q 1/405* (2013.01)

(58) Field of Classification Search
CPC ..... H01Q 1/362; H01Q 1/405; H01Q 1/48; H01Q 3/00; H01Q 3/02; H01Q 3/08
See application file for complete search history.

(56) References Cited

U.S. PATENT DOCUMENTS

| | | | | | |
|---|---|---|---|---|---|
| 2,960,693 | A * | 11/1960 | Fry | H01Q 3/08 | 343/765 |
| 3,999,184 | A * | 12/1976 | Fuss, III | H01Q 3/08 | 343/709 |
| 4,825,218 | A * | 4/1989 | Begout | H01Q 1/125 | 343/765 |
| 4,841,309 | A * | 6/1989 | Burr | H01Q 1/125 | 343/766 |
| 5,153,485 | A * | 10/1992 | Yamada | F16M 11/10 | 318/35 |
| 5,619,215 | A * | 4/1997 | Sydor | H01Q 3/08 | 343/765 |
| 2002/0140620 | A1 | 10/2002 | Yamauchi et al. | | |
| 2006/0114164 | A1 | 6/2006 | Iluz et al. | | |
| 2012/0119973 | A1 | 5/2012 | Ahring et al. | | |

FOREIGN PATENT DOCUMENTS

| | | | |
|---|---|---|---|
| JP | 8-271642 | A | 10/1996 |
| JP | 9-8533 | A | 1/1997 |
| JP | 2002-158524 | A | 5/2002 |
| JP | 3428858 | B | 5/2003 |
| JP | 2003-273631 | A | 9/2003 |
| JP | 2006-308510 | A | 11/2006 |
| JP | 2008-228045 | A | 9/2008 |

OTHER PUBLICATIONS

Extended European Search Report dated Mar. 6, 2019 in European Application No. 16821151.4-1205.

* cited by examiner

ANTENNA

CROSS REFERENCE TO RELATED APPLICATIONS

This application is a Continuation of Application of International Application No. PCT/JP/2016/066818 filed on Jun. 7, 2016. This application claims priority to Japanese Patent Application No. 2015-135976 filed on Jul. 7, 2015. The entire disclosure of Japanese Patent Application No. 2015-135976 and International Application No. PCT/JP/2016/066818 are hereby incorporated herein by reference.

TECHNICAL FIELD

The present disclosure mainly relates to an antenna, which receives an electromagnetic wave.

BACKGROUND

Patent Document 1 discloses an antenna provided to a radar apparatus. This antenna is rotatably configured so that an elevation-depression angle and an azimuth angle change.

Patent Documents 2 and 3 disclose control devices, each controls attitude of a directional antenna mounted on a movable body. The antenna has two rotation axes located within a horizontal plane, and one rotation axis parallel to a vertical direction. The control devices control the directional antenna to face toward a particular satellite by rotating the directional antenna around the rotation axes described above even when the movable body rocks or a traveling direction thereof changes. Although the directional antennas of Patent Documents 2 and 3 have three rotation axes, the directional antennas cannot rotate in their circumferential directions.

Patent Document 4 discloses a control device which adjusts an orientation of a directional antenna so that it faces toward a particular satellite, similar to Patent Documents 2 and 3. In the control device of Patent Document 4, the directional antenna can be rotated so that an elevation-depression angle, an azimuth angle and an antenna circumferential angle (a rotational angle of the directional antenna in its circumferential direction) change.

REFERENCE DOCUMENTS OF CONVENTIONAL ART

Patent Documents

[Patent Document 1] JPS60-030613U
[Patent Document 2] JPH09-008533A
[Patent Document 3] JP3428858B
[Patent Document 4] JP2003-273631A

SUMMARY

Patent Documents 1 to 3 do not disclose a change in an antenna circumferential angle. While Patent Document 4 discloses the change in the antenna circumferential angle, the disclosure does not cover a detailed configuration regarding a method of transmitting a driving force etc.

The present disclosure is made in view of the above situations, and mainly aims to provide a detailed configuration regarding a method of transmitting a driving force etc., of an antenna adjustable of an elevation-depression angle and an antenna circumferential angle.

The problems to be solved by the present disclosure is described as above, and measures to solve the problems and effects thereof will be described as follows.

According to one aspect of the present disclosure, an antenna with the following structure may be provided. That is, the receiver includes an antenna, a column, a first shaft and a second shaft. The antenna receives an electromagnetic wave. The column supports the antenna. The first shaft transmits a driving force that changes an elevation-depression angle of the antenna. The second shaft transmits the driving force that changes a rotational angle of the antenna about an axis parallel to a wave propagation.

Thus, the receiver which is adjustable of the elevation-depression angle of the antenna and the rotational angle of the antenna about the axis parallel to the wave propagation independently may be achieved by using the two drive transmission shafts. Further, by transmitting the driving force using the drive transmission shafts, the driving force may be transmitted more reliably compared with a configuration in which the driving force is transmitted using a belt etc.

The receiver may include a support part configured to support the column.

Thus, by also supporting the column, the antenna may stably be supported.

With the receiver, the first shaft, the second shaft, and the column may be positioned at least on an upper side of the support part.

Thus, driving force of drive parts positioned below the support part may be transmitted to the antenna positioned above the support part.

With the receiver, one of the first shaft and the second shaft may have a changeable length.

Thus, even when the rotational angle of the antenna about the axis parallel to the wave propagation changes greatly, one of the first shaft and the second shaft may function without problems.

The receiver may have the following structure. That is, the receiver includes an first drive part and a second drive part. The first drive part generates the driving force that changes the elevation-depression angle of the antenna. The second drive part generates the driving force that changes the rotational angle of the antenna about the axis parallel to the wave propagation. The first drive part and the second drive part are positioned below the support part.

Thus, since the two drive parts which change the elevation-depression angle of the antenna and rotationally drive the antenna about the axis parallel to the wave propagation may be positioned below the support part, the center of gravity may be lowered so that attitude of the antenna is stabilized.

With the receiver, the first shaft may have a changeable length.

Thus, even when the rotational angle of the antenna about the axis parallel to the wave propagation changes greatly, the first shaft may function without problems.

The receiver may have the following structure. That is, the changeable length of the first shaft is changeable in multi-stages. The receiver includes a biasing member configured to bias the first shaft in a length direction of the first shaft.

Thus, even when large force is applied to the first shaft due to the own weight etc. of the first shaft, the attitude of the first shaft may be prevented from collapsing.

The receiver may include a third drive part configured to rotationally drive the support part to change an azimuth angle of the antenna, and the third drive part may be positioned below the support part.

Thus, a weather radar antenna which is adjustable of the three rotational angles independently may be achieved. Further, since the third drive part may be positioned below the support part, the center of gravity of the antenna may be lowered so that the attitude of the antenna is stabilized even more.

With the receiver, the first drive part, the second drive part, and the third drive part may be located at positions not being rotationally driven by any of the first drive part, the second drive part, and the third drive part.

Thus, the three drive parts which rotationally drive the antenna are positioned below the support part. Therefore, the center of gravity of the receiver may be lowered even more so that the attitude of the receiver is stabilized. Further, since it may be unnecessary to rotate the drive parts which are heavy objects, the attitude of the receiver may be stabilized even more.

With the receiver, the first drive part, the second drive part, and the third drive part may be positioned at the same height as each other.

Thus, the receiver may be downsized compared with a structure in which the three drive parts which rotationally drive the antenna are positioned at different heights to each other.

The receiver may have the following structure. That is, an output shaft of the first drive part is attached to an upper portion of the first drive part. An output shaft of the second drive part is attached to an upper portion of the second drive part. An output shaft of the third drive part is attached to a lower portion of the third drive part.

Thus, since a gear which is meshed with the output shaft of the third drive part may be positioned low, the center of gravity may be lowered.

The receiver may have the following structure. That is, the receiver includes a signal processor configured to perform signal processing on the electromagnetic wave received by the antenna. The signal processor is positioned at a position not being rotationally driven by the third drive part.

Thus, targets to be rotationally driven by the third drive part may be reduced, and therefore load on the third drive part may be reduced.

With the receiver may include a waveguide formed within the column to pass the electromagnetic wave received by the antenna.

Thus, since the column and the waveguide may integrally be structured, the number of components may be reduced. In addition, the receiver may be reduced in weight.

The receiver may have the following structure. That is, the column may include a base part made of metal, in which the waveguide is formed, and a cover part made of fiber reinforced plastic, externally covering the base part.

Thus, by including the cover part made of fiber reinforced plastic, the antenna may be reduced in weight and a vibration absorbability may be improved.

With the receiver, the column may be positioned between the first shaft and the second shaft.

Thus, since the position of the column may be brought close to the center, the antenna may stably be supported. In addition, a channel for electromagnetic wave may be simplified.

The receiver may be mounted on a movable body.

Thus, since the antenna may easily shift in position in the movable body due to rocking etc., the effect of the present disclosure of lowering the center of gravity to stabilize the attitude may particularly effectively be exerted.

The receiver may used for a weather radar.

Thus, the receiver which is adjustable of the elevation-depression angle of the weather radar antenna and the rotational angle of the antenna about the axis parallel to the wave propagation independently may be achieved by using the two drive transmission shafts.

According to one aspect of the present disclosure, a device to be connected to an antenna with the following structure may be provided. That is, a column, a first shaft and a second shaft. The column supports the antenna. The first shaft transmits a driving force that changes an elevation-depression angle of the antenna. The second shaft transmits the driving force that changes a rotational angle of the antenna about an axis parallel to a wave propagation.

Thus, the device which is adjustable of the elevation-depression angle of the antenna and the rotational angle of the antenna about the axis parallel to the wave propagation independently may be achieved by using the two drive transmission shafts.

With the device, the column may be positioned between the first shaft and the second shaft.

Thus, since the position of the column may be brought close to the center, the antenna may stably be supported.

DETAILED DESCRIPTION

Next, one embodiment of the present disclosure is described with reference to the appended drawings.

A weather radar antenna 1 may transmit an electromagnetic wave from an antenna unit 5 to the outside and receive a reflection wave caused by reflection on rain or snow etc. The reflection wave received by the weather radar antenna 1 (reception signal) may be amplified, A/D-converted etc. and then transmitted to an analyzer. The analyzer may calculate data on rain and snow etc. around the antenna unit 5 by analyzing the reception signal.

Figure 1:
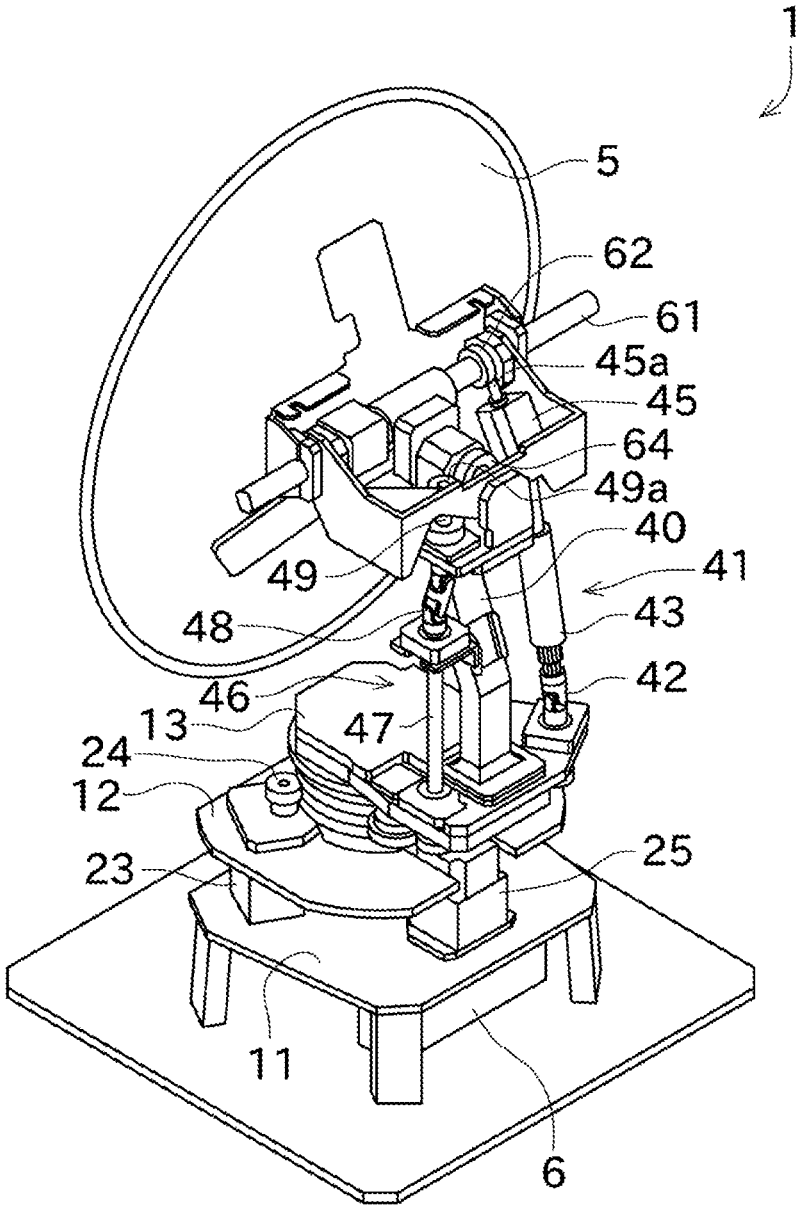
FIG. 1 is a perspective view of a weather radar antenna according to one embodiment of the present disclosure.
Figure 2:
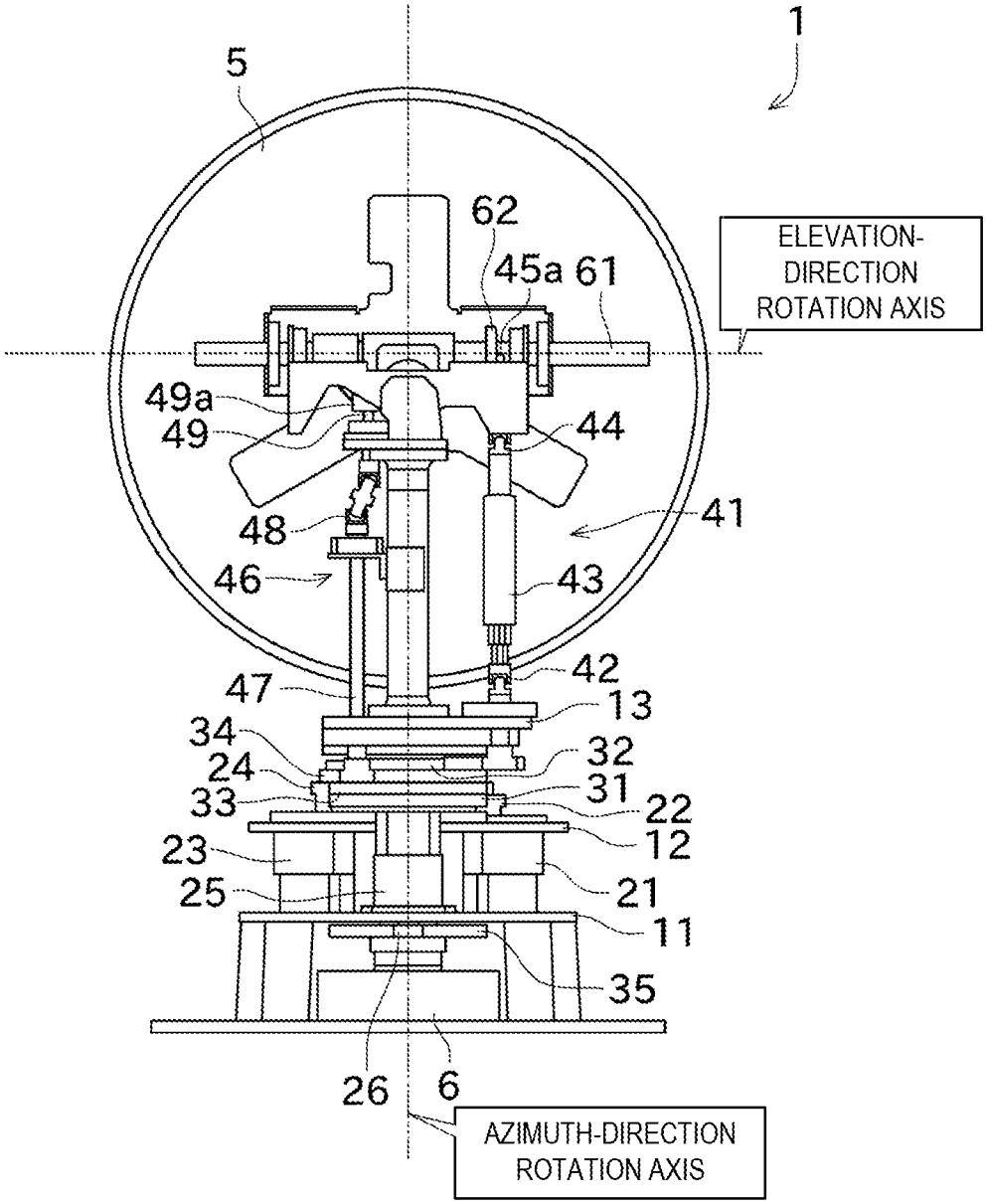
FIG. 2 is a rear view of the weather radar antenna when it is not rotating in an antenna circumferential direction.
Figure 3:
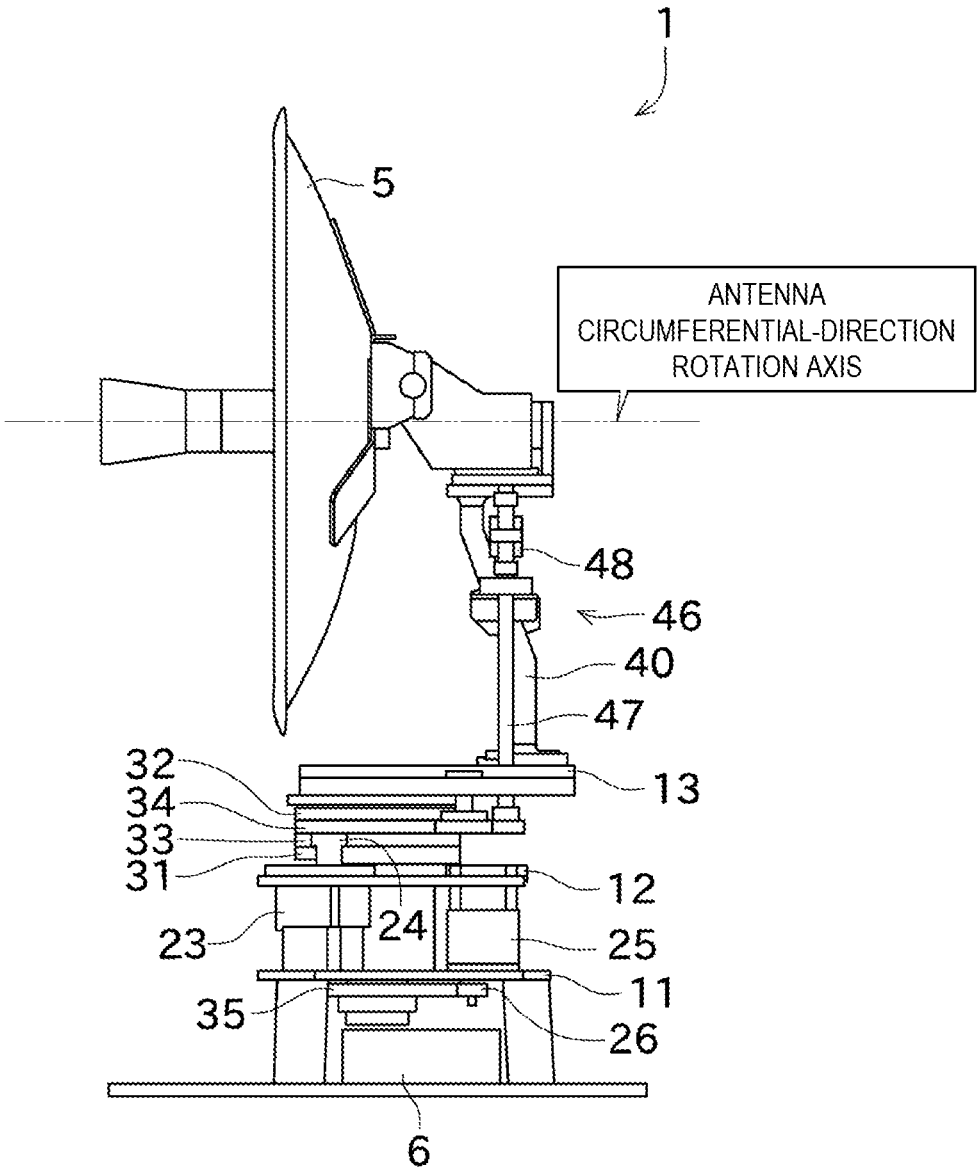
FIG. 3 is a side view of the weather radar antenna.

As illustrated in FIGS. 1 to 3, the weather radar antenna (receiver) 1 may be is provided with the antenna unit (antenna) 5. The antenna unit 5 may perform the transmission of the electromagnetic wave to the outside and the reception of the reflection wave from the outside. The antenna unit 5 may have a circular shape when seen in a transmission direction of the electromagnetic wave and have a parabolic sectional shape when cut by a plane parallel to the transmission direction of the electromagnetic wave.

The weather radar antenna 1 may include a lower support base 11, an upper support base 12 and a rotation support base (support part) 13 in this order from the lower side (installation surface side). The lower support base 11 may be provided at a position higher than the installation surface of the weather radar antenna 1. A signal processor 6 configured to perform amplification, A/D conversion etc. may be disposed below the lower support base 11.

An azimuth-direction drive motor (third drive part) 25 may be attached to the lower support base 11. The azimuth-direction drive motor 25 may be disposed so that a lower part thereof is supported by the lower support base 11 (in other words, a major part of the azimuth-direction drive motor 25 is positioned between the lower support base 11 and the upper support base 12). The azimuth-direction drive motor 25 may rotationally drive at least the antenna unit 5 to change an azimuth angle of the antenna unit 5 (an angle taken by having a height direction (vertical direction) as a rotation axis).

For example, an output shaft 26 may be attached to a lower part of the azimuth-direction drive motor 25. The output shaft 26 may be meshed with an azimuth-direction rotation gear 35, and the azimuth-direction rotation gear 35 may be rotated by rotating the azimuth-direction drive motor 25. Further, the azimuth-direction rotation gear 35 may transmit a driving force to the rotation support base 13 via a shaft member (not illustrated) disposed inside the azimuth-direction rotation gear 35. Thus, the azimuth angle of the antenna unit 5 may be changed.

Note that even when the rotation support base 13 is rotated, the lower support base 11, the upper support base 12, three motors, the signal processor 6, etc. may not rotate (in other words, these processor or members may be disposed at positions where they are not rotationally driven by any of the three motors). In particular, since it is unnecessary to rotate the motors and the signal processor 6 which are heavy objects, an output of the azimuth-direction drive motor 25 may be reduced.

The upper support base 12 may be provided at a position higher than the lower support base 11. An elevation-depression-direction drive motor (first drive part) 21 and a circumferential-direction drive motor (second drive part) 23 may be attached to the upper support base 12. The elevation-depression-direction drive motor 21 and the circumferential-direction drive motor 23 may be disposed so that upper parts thereof are supported by the upper support base 12 (in other words, a major part of the elevation-depression-direction drive motor 21 and the circumferential-direction drive motor 23 is positioned between the lower support base 11 and the upper support base 12).

Thus, the three motors (the elevation-depression-direction drive motor 21, the circumferential-direction drive motor 23 and the azimuth-direction drive motor 25) may be arranged at the same height (below the rotation support base 13). Therefore, the height of the weather radar antenna 1 may be lowered compared with a structure in which the motors are arranged at different heights. Further, since the motors, which are heavy objects, may be disposed at positions relatively low in height, the weather radar antenna 1 may be stabilized.

The elevation-depression-direction drive motor 21 may rotationally drive at least the antenna unit 5 to change an elevation-depression angle of the antenna unit 5 (the angle taken when the direction parallel to the installation surface is the rotation axis). For example, an output shaft 22 may be attached to an upper part of the elevation-depression-direction drive motor 21. The output shaft 22 may be meshed with a first elevation-depression-direction rotation gear 31, and the first elevation-depression-direction rotation gear 31 may be rotated by rotating the elevation-depression-direction drive motor 21.

A second elevation-depression-direction rotation gear 32 configured to rotate integrally with the first elevation-depression-direction rotation gear 31 may be disposed above the first elevation-depression-direction rotation gear 31. A driving force transmitted to the second elevation-depression-direction rotation gear 32 may be transmitted to an elevation-depression-direction drive transmission shaft (first shaft) 41 via other gears. Note that the manner of effects of the driving force transmitted to the elevation-depression-direction drive transmission shaft 41 is described later.

The circumferential-direction drive motor 23 may rotationally drive at least the antenna unit 5 to change a rotational angle of the antenna unit 5 in its circumferential direction (antenna circumferential angle, a rotational angle taken by having a rotation axis on a line parallel to the transmission direction of the electromagnetic wave and passing through the center of the circle of the antenna unit 5 to be exact). For example, an output shaft 24 may be attached to an upper part of the circumferential-direction drive motor 23. The output shaft 24 may be meshed with a first circumferential-direction rotation gear 33, and the first circumferential-direction rotation gear 33 may be rotated by rotating the circumferential-direction drive motor 23.

A second circumferential-direction rotation gear 34 configured to rotate integrally with the first circumferential-direction rotation gear 33 may be disposed above the first circumferential-direction rotation gear 33. A driving force transmitted to the second circumferential-direction rotation gear 34 may be transmitted to a circumferential-direction drive transmission shaft (second shaft) 46 via other gears. Note that the manner of effects of the driving force transmitted to the circumferential-direction drive transmission shaft 46 is described later.

The rotation support base 13 may be provided at a position higher than the upper support base 12. A column 40 may be located on an upper side of the rotation support base 13. The elevation-depression-direction drive transmission shaft 41 and the circumferential-direction drive transmission shaft 46 may be located at least on the upper side of the rotation support base 13. Note that in this embodiment, the elevation-depression-direction drive transmission shaft 41 and the circumferential-direction drive transmission shaft 46 may also be located on a lower side of the rotation support base 13 to be exact. The rotation support base 13 may support the column 40 (thus support the antenna unit 5). In the rear view (FIG. 2), the column 40 may be disposed substantially at the center, the elevation-depression-direction drive transmission shaft 41 may be disposed on the right side of the column 40, and the circumferential-direction drive transmission shaft 46 may be disposed on the left side of the column 40.

Figure 5:
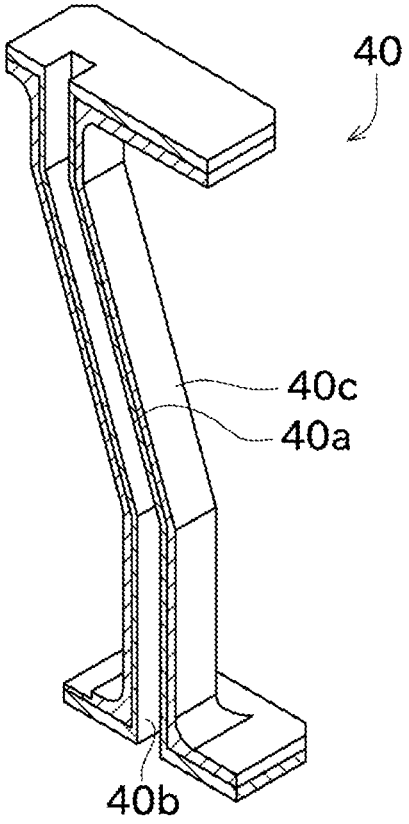
FIG. 5 is a cross-sectional perspective view illustrating a wave channel formed inside a column.

The column 40 may be a member configured to support the antenna unit 5. The column 40 may be an elongated member and configured to include a part extending upward from the rotation support base 13 and a part extending obliquely upward to the front side. As illustrated in FIG. 5, the column 40 may include a base part **40*a* and a cover part 40*c***.

The base part **40*a* may constitute an inner part of the column 40 and be made of metal such as iron or aluminum. The cover part 40*c* may be a member externally covering the base portion 40*a*** and made of fiber reinforced plastic (FRP) such as carbon fiber reinforced plastic (CFRP) or glass fiber reinforced plastic (GFRP).

By using FRP for a member which supports the antenna unit 5 as described above, vibration occurring when the antenna unit 5 rotates may be absorbed. Further, the weight may be less compared with a column made only of metal. Since the column 40 is disposed at the relatively upper side of the weather radar antenna 1, by reducing its weight, an attitude stability may also be improved.

Moreover, the base part 40*a* may be hollow and the hollow portion may be used as a wave channel 40*b*. That is, the electromagnetic wave generated by a transmission signal generator (not illustrated) may be transmitted from the lower side of the rotation support base 13 to the wave channel 40*b*, travel upward along the wave channel 40*b*, and be transmitted from the antenna unit 5 to the outside. Further, the reflection wave received by the antenna unit 5 may be transmitted to the wave channel 40*b*, travel downward along the wave channel 40*b*, and be amplified, A/D converted etc. by the signal processor 6.

In this manner, since the column 40 may have the function of supporting the antenna unit 5 and the function as the waveguide, the number of components may be reduced. Further, in the rear view (FIG. 2), the column 40 may extend linearly and be disposed to pass through the center of the antenna unit 5. Therefore, the antenna unit 5 may be supported in a well-balanced manner and the wave channel may be formed simply (so as to reduce the number of bending times).

The elevation-depression-direction drive transmission shaft 41 may be disposed so that its axial direction becomes the vertical direction (height direction). The elevation-depression-direction drive transmission shaft 41 may be rotated by receiving the driving force of the elevation-depression-direction drive motor 21, and transmit the driving force from the lower side of the rotation support base 13 to the antenna unit 5 located above the rotation support base 13. The elevation-depression-direction drive transmission shaft 41 may include a universal joint 42, a spline shaft 43, a universal joint 44 and a transmission shaft 45.

The spline shaft 43 may rotate around the axial direction (vertical direction) as the rotation axis by receiving the driving force of the elevation-depression-direction drive motor 21, so as to transmit the driving force. For example, the spline shaft 43 may transmit the driving force by meshing a concave portion with a convex portion formed in the axial direction.

Figure 6:
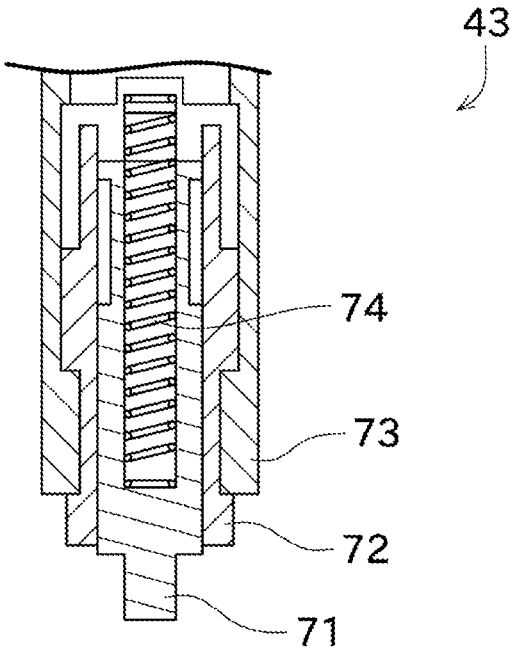
FIG. 6 is a cross-sectional view illustrating an elevation-depression-direction drive transmission shaft (spline shaft) in a contracted state.
Figure 7:
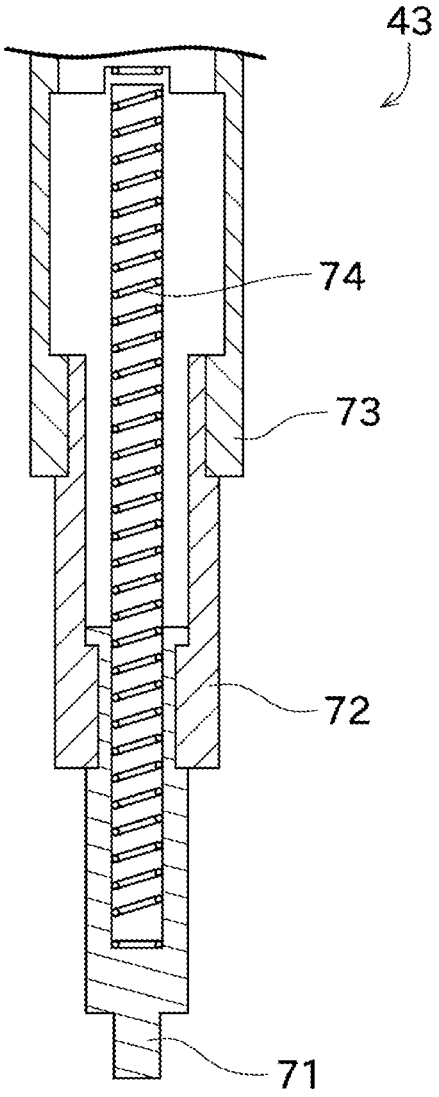
FIG. 7 is a cross-sectional view illustrating the elevation-depression-direction drive transmission shaft (spline shaft) in an expanded state.

As illustrated in FIGS. 6 and 7, the spline shaft 43 may have a three-layer structure comprised of a first member 71, a second member 72 and a third member 73 in this order from the inside. Note that in FIGS. 6 and 7, for easier understanding of the drawings, the illustration of the concave portion and the convex portion is omitted. The first to third members 71 to 73 may be configured to be movable in the axial direction. Thus, the length of the spline shaft 43 in the axial direction may be changeable.

Further, a spring (biasing member) 74 may be attached inside the spline shaft 43. The spring 74 may prevent that, when large force is applied to the elevation-depression-direction drive transmission shaft 41 due to the own weight etc. of the elevation-depression-direction drive transmission shaft 41, the elevation-depression-direction drive transmission shaft 41 is bent at the universal joint 42 and the attitude collapses. Note that, in a case of pulling up the universal joint 42 to bias the spline shaft 43 in the expansion direction, other than the spring may be used as the biasing member.

A screw gear 45*a* may be attached to an upper end of the transmission shaft 45. The screw gear 45*a* may be disposed to mesh with a helical gear 62 attached to an elevation-depression-direction rotation shaft 61 of the antenna unit 5. The driving force transmitted to the screw gear 45*a* may rotate the helical gear 62 and the elevation-depression-direction rotation shaft 61. Thus, the elevation-depression angle of the antenna unit 5 may be changed by the driving force of the elevation-depression-direction drive motor 21.

Figure 4:
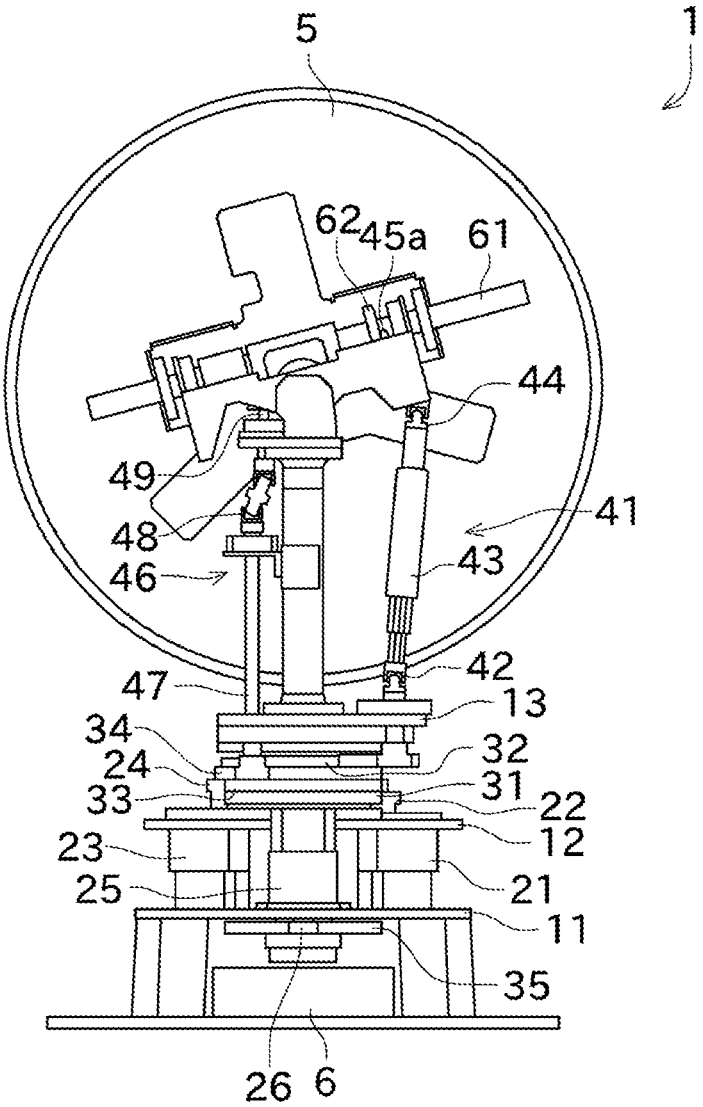
FIG. 4 is a rear view of the weather radar antenna after rotating in the antenna circumferential direction.

The universal joint 42 may couple the rotation support base 13 to the spline shaft 43 at an arbitrary angle. The universal joint 44 may couple the spline shaft 43 to the transmission shaft 45 at an arbitrary angle. Thus, they may be adaptable to a change of the antenna circumferential angle (FIG. 4).

The circumferential-direction drive transmission shaft 46 may be disposed so that its axial direction becomes the vertical direction (height direction). The circumferential-direction drive transmission shaft 46 may be rotated by receiving the driving force of the circumferential-direction drive motor 23, and transmit the driving force from the lower side of the rotation support base 13 to the antenna unit 5 located above the rotation support base 13. The circumferential-direction drive transmission shaft 46 may include a shaft 47, a universal joint 48 and a transmission shaft 49.

The shaft 47 may rotate around the axial direction (vertical direction) as the rotation axis by receiving the driving force of the circumferential-direction drive motor 23. The universal joint 48 may couple the shaft 47 to the transmission shaft 49 at an arbitrary angle.

A screw gear 49*a* may be attached to an upper end of the transmission shaft 49. The screw gear 49*a* may be disposed to mesh with a helical gear 64 of the antenna unit 5. The rotation axis direction of the helical gear 64 may be configured to coincide with the rotation axis of the antenna circumferential angle (a line parallel to the transmission direction of the electromagnetic wave and passing through the center of the circle of the antenna unit 5), and rotate integrally with the antenna unit 5. Thus, the circumferential angle of the antenna unit 5 may be changed by the driving force of the circumferential-direction drive motor 23.

Thus in this embodiment, the elevation-depression angle, the antenna circumferential angle and the azimuth angle of the antenna unit 5 may independently be changed by the three motors. Further, by controlling the rotational angles of the motors based on the detection result of a sensor (not illustrated) which detects a rocking motion, the three motors may reduce an error according to the rocking motion. Therefore, highly accurate data may be acquired even under an environment where a ship etc. rocks greatly.

Further, the lower support base 11 and the upper support base 12 may not rotate even when any of the three motors rotates. Therefore, the three motors themselves and the signal processor 6 may not rotate due to driving of the motor. Since it is unnecessary to rotationally drive the motor which is a heavy object, the output of the motor may be reduced.

As described above, the weather radar antenna 1 may include the antenna unit 5, the column 40, the elevation-depression-direction drive transmission shaft 41 and the circumferential-direction drive transmission shaft 46. The antenna unit 5 may receive at least the electromagnetic wave. The column 40 may support the antenna unit 5. The elevation-depression-direction drive transmission shaft 41 may transmit the driving force of the elevation-depression-direction drive motor 21 to the antenna. The circumferential-direction drive transmission shaft 46 may transmit the driving force of the circumferential-direction drive motor 23 to the antenna unit 5.

Thus, the weather radar antenna 1 which is adjustable of the elevation-depression angle of the antenna unit 5 and the rotational angle of the antenna unit 5 in the circumferential direction independently may be achieved by using the two drive transmission shafts. Further, by transmitting the driving force using the two drive transmission shafts, the driving force may be transmitted more reliably compared with a configuration in which the driving force is transmitted using a belt etc.

Figure 8:
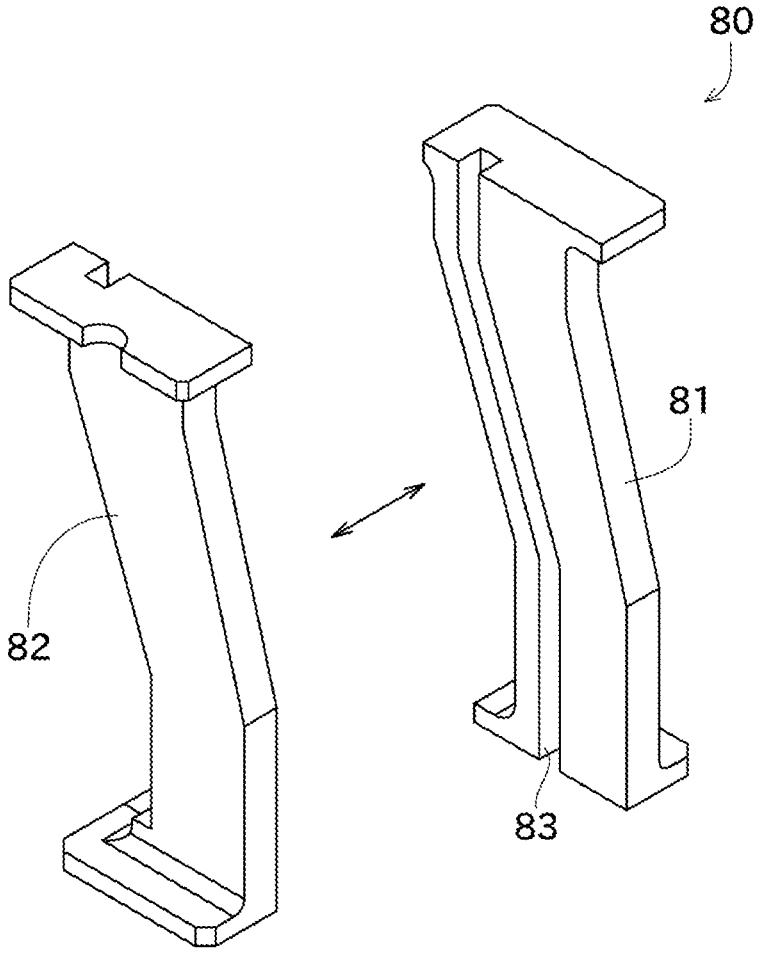
FIG. 8 is a cross-sectional perspective view illustrating a wave channel formed inside a column according to one modification.

Next, a modification of the above embodiment is described with reference to FIG. 8. FIG. 8 is an exploded perspective view illustrating a structure of a column 80 according to the modification. Note that in the description of this modification, the same reference characters are applied to the same or similar members as those of the above embodiment, and the description thereof may be omitted.

In the above embodiment, the column 40 may include the metallic base part 40*a* and the FRP cover part 40*c*; however, in this modification, the column 80 may only include a metallic member. For example, the column 80 may be constructed by coupling symmetrically-molded column components 81 and 82. The column component 81 may be formed with a groove 83, and the column component 82 may also be formed with a groove (not illustrated) at a position corresponding to the groove 83. This groove 83 may be combined with the non-illustrated groove to constitute a wave channel.

Although the suitable embodiment and modification of the present disclosure are described above, the above configurations may be modified as follows.

Although in the above embodiment, the three angles including the elevation-depression angle, the azimuth angle, and the antenna circumferential angle may be adjusted, a configuration in which only the elevation-depression angle and the antenna circumferential angle are adjustable may be adopted.

The shape of each member constituting the weather radar antenna 1 is arbitrary and may suitably be changed. Further, as long as the configuration of the present application is achieved, the arrangement of each member may be changed or omitted. For example, the arrangement and the number of gears which transmit the driving force of the three motors are arbitrary and may suitably be changed. Moreover, the spline shaft 43 may be structured in two, four or more layers instead of the three-layer structure. Furthermore, although the column 40, the elevation-depression-direction drive transmission shaft 41, and the circumferential-direction drive transmission shaft 46 may be located only above the rotation support base 13, they may also be located below the rotation support base 13. In addition, although in the above embodiment only the elevation-depression-direction drive transmission shaft 41 may be expandable and contractible out of the elevation-depression-direction drive transmission shaft 41 and the circumferential-direction drive transmission shaft 46, it may be such that at least one of them is expandable and contractible.

Although the above embodiment describes the weather radar antenna 1 installed on the ship as one example, the installation position is arbitrary and may suitably be changed. For example, it may be installed in another movable body or in a building.

The weather radar antenna 1 may have a structure in which it is covered by a cover (radome) made of a material with high radio wave transmittance.

TERMINOLOGY

It is to be understood that not necessarily all objects or advantages may be achieved in accordance with any particular embodiment described herein. Thus, for example, those skilled in the art will recognize that certain embodiments may be configured to operate in a manner that achieves or optimizes one advantage or group of advantages as taught herein without necessarily achieving other objects or advantages as may be taught or suggested herein.

All of the processes described herein may be embodied in, and fully automated via, software code modules executed by a computing system that includes one or more computers or processors. The code modules may be stored in any type of non-transitory computer-readable medium or other computer storage device. Some or all the methods may be embodied in specialized computer hardware.

Many other variations than those described herein will be apparent from this disclosure. For example, depending on the embodiment, certain acts, events, or functions of any of the algorithms described herein can be performed in a different sequence, can be added, merged, or left out altogether (e.g., not all described acts or events are necessary for the practice of the algorithms). Moreover, in certain embodiments, acts or events can be performed concurrently, e.g., through multi-threaded processing, interrupt processing, or multiple processors or processor cores or on other parallel architectures, rather than sequentially. In addition, different tasks or processes can be performed by different machines and/or computing systems that can function together.

The various illustrative logical blocks and modules described in connection with the embodiments disclosed herein can be implemented or performed by a machine, such as a processor. A processor can be a microprocessor, but in the alternative, the processor can be a controller, microcontroller, or state machine, combinations of the same, or the like. A processor can include electrical circuitry configured to process computer-executable instructions. In another embodiment, a processor includes an application specific integrated circuit (ASIC), a field programmable gate array (FPGA) or other programmable device that performs logic operations without processing computer-executable instructions. A processor can also be implemented as a combination of computing devices, e.g., a combination of a digital signal processor (DSP) and a microprocessor, a plurality of microprocessors, one or more microprocessors in conjunction with a DSP core, or any other such configuration. Although described herein primarily with respect to digital technology, a processor may also include primarily analog components. For example, some or all of the signal processing algorithms described herein may be implemented in analog circuitry or mixed analog and digital circuitry. A computing environment can include any type of computer system, including, but not limited to, a computer system based on a microprocessor, a mainframe computer, a digital signal processor, a portable computing device, a device controller, or a computational engine within an appliance, to name a few.

Conditional language such as, among others, "can," "could," "might" or "may," unless specifically stated otherwise, are otherwise understood within the context as used in general to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without user input or prompting, whether these features, elements and/or steps are included or are to be performed in any particular embodiment.

Disjunctive language such as the phrase "at least one of X, Y, or Z," unless specifically stated otherwise, is otherwise understood with the context as used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present.

Any process descriptions, elements or blocks in the flow diagrams described herein and/or depicted in the attached figures should be understood as potentially representing modules, segments, or portions of code which include one or more executable instructions for implementing specific logical functions or elements in the process. Alternate implementations are included within the scope of the embodiments described herein in which elements or functions may be deleted, executed out of order from that shown, or discussed, including substantially concurrently or in reverse order, depending on the functionality involved as would be understood by those skilled in the art.

Unless otherwise explicitly stated, articles such as "a" or "an" should generally be interpreted to include one or more described items. Accordingly, phrases such as "a device configured to" are intended to include one or more recited devices. Such one or more recited devices can also be collectively configured to carry out the stated recitations. For example, "a processor configured to carry out recitations A, B and C" can include a first processor configured to carry out recitation A working in conjunction with a second processor configured to carry out recitations B and C. The same holds true for the use of definite articles used to introduce embodiment recitations. In addition, even if a specific number of an introduced embodiment recitation is explicitly recited, those skilled in the art will recognize that such recitation should typically be interpreted to mean at least the recited number (e.g., the bare recitation of "two recitations," without other modifiers, typically means at least two recitations, or two or more recitations).

It will be understood by those within the art that, in general, terms used herein, are generally intended as "open" terms (e.g., the term "including" should be interpreted as "including but not limited to," the term "having" should be interpreted as "having at least," the term "includes" should be interpreted as "includes but is not limited to," etc.).

For expository purposes, the term "horizontal" as used herein is defined as a plane parallel to the plane or surface of the floor of the area in which the system being described is used or the method being described is performed, regardless of its orientation. The term "floor" can be interchanged with the term "ground" or "water surface". The term "vertical" refers to a direction perpendicular to the horizontal as just defined. Terms such as "above," "below," "bottom," "top," "side," "higher," "lower," "upper," "over," and "under," are defined with respect to the horizontal plane.

As used herein, the terms "attached," "connected," "mated," and other such relational terms should be construed, unless otherwise noted, to include removable, moveable, fixed, adjustable, and/or releasable connections or attachments. The connections/attachments can include direct connections and/or connections having intermediate structure between the two components discussed.

Numbers preceded by a term such as "approximately", "about", and "substantially" as used herein include the recited numbers, and also represent an amount close to the stated amount that still performs a desired function or achieves a desired result. For example, the terms "approximately", "about", and "substantially" may refer to an amount that is within less than 10% of the stated amount. Features of embodiments disclosed herein preceded by a term such as "approximately", "about", and "substantially" as used herein represent the feature with some variability that still performs a desired function or achieves a desired result for that feature.

It should be emphasized that many variations and modifications may be made to the above-described embodiments, the elements of which are to be understood as being among other acceptable examples. All such modifications and variations are intended to be included herein within the scope of this disclosure and protected by the following claims.

What is claimed is:

1. A device to be connected to an antenna, the device comprising:

a column configured to support the antenna;

a first shaft configured to change in length and rotate about an axial direction to transmit to the antenna a driving force that changes an elevation-depression angle of the antenna; and a second shaft of a fixed length configured to rotate around a vertical axis transmit to the antenna a driving force that changes a rotational angle of the antenna about an axis parallel to a wave propagation.

2. The device of claim 1, comprising a support base configured to support the column.

3. The device of claim 2, wherein the first shaft, the second shaft, and the column are positioned at least on an upper side of the support base.

4. The device of claim 1, comprising:

a first drive motor configured to generate the driving force that changes the elevation-depression angle of the antenna; and a second drive motor configured to generate the driving force that changes the rotational angle of the antenna about the axis parallel to the wave propagation, wherein the first drive motor and the second drive motor are positioned below the support base.

5. The device of claim 1, wherein, the changeable length of the first shaft is changeable in multi-stages, and the device comprises a biasing member configured to bias the first shaft in a length direction of the first shaft.

6. The device of claim 1, further comprising a waveguide formed within the column to pass the electromagnetic wave received by the antenna.

7. The device of claim 6, wherein the column includes:

a base made of metal, in which the waveguide is formed; and a cover made of fiber reinforced plastic, externally covering the base.

8. The device of claim 1, wherein the column is positioned between the first shaft and the second shaft.

9. The device of claim 1, wherein the device is configured to be mounted on a movable body.

10. The device of claim 1, wherein the device is used for a weather radar.

11. A device to be connected to an antenna, the device comprising:

a column configured to support the antenna;

a first shaft configured to transmit to the antenna a driving force that changes an elevation-depression angle of the antenna;

a second shaft configured to transmit to the antenna a driving force that changes a rotational angle of the antenna about an axis parallel to a wave propagation;

a support base configured to support the column;

a first drive motor configured to generate the driving force that changes the elevation-depression angle of the antenna;

a second drive motor configured to generate the driving force that changes the rotational angle of the antenna about the axis parallel to the wave of propagation; and a third drive motor configured to rotationally drive the support part to change an azimuth angle of the antenna, wherein the first drive motor, the second drive motor and the third drive motor are positioned below the support base.

12. The device of claim 11, wherein the first drive motor, the second drive motor, and the third drive motor are located at positions not being rotationally driven by any of the first drive motor, the second drive motor, and the third drive motor.

13. The device of claim 11, wherein the first drive motor, the second drive motor, and the third drive motor are positioned at the same height as each other.

14. The device of claim 11, wherein, an output shaft of the first drive motor is attached to an upper portion of the first drive motor, an output shaft of the second drive motor is attached to an upper portion of the second drive motor, and an output shaft of the third drive motor is attached to a lower portion of the third drive motor.

15. The device of claim 11 comprising a signal processor configured to perform signal processing on the electromagnetic wave received by the antenna, wherein the signal processor is positioned at a position not being rotationally driven by the third drive motor.

16. A device to be connected to an antenna, comprising:

a column configured to support the antenna;

a first shaft configured to transmit to the antenna a driving force that changes an elevation-depression angle of the antenna; and a second shaft configured to transmit to the antenna a driving force that changes a rotational angle of the antenna about an axis parallel to a wave propagation;

a support base configured to support the column, wherein the first shaft, the second shaft and the column are positioned at least on an upper side of the support base;

a first drive motor configured to generate the driving force that changes the elevation-depression angle of the antenna; and a second drive motor configured to generate the driving force that changes the rotational angle of the antenna about the axis parallel to the wave propagation, wherein the first drive motor and the second drive motor are positioned below the support base.

17. The device of claim 16, wherein the column is positioned between the first shaft and the second shaft.

18. The device of claim 16, wherein the first shaft is configured to change in length and rotate about an axial direction, and the second shaft is of a fixed length.

19. The device of claim 16, further comprising:

a third drive motor configured to rotationally drive the support part to change an azimuth angle of the antenna.

20. The device of claim 19, wherein the first drive motor, the second drive motor and the third drive motor are positioned below the support base.

* * * * *